US010240283B2

(12) United States Patent
Gupta et al.

(10) Patent No.: US 10,240,283 B2
(45) Date of Patent: Mar. 26, 2019

(54) FABRIC AND METHOD OF MANUFACTURING FABRIC

(71) Applicant: Trident Limited, Sanghera (IN)

(72) Inventors: Abhishek Gupta, Sanghera (IN); Swadesh Kumar, Barnala (IN)

(73) Assignee: Trident Limited (IN)

( * ) Notice: Subject to any disclaimer, the term of this patent is extended or adjusted under 35 U.S.C. 154(b) by 203 days.

(21) Appl. No.: 15/368,899

(22) Filed: Dec. 5, 2016

(65) Prior Publication Data

US 2017/0159233 A1 Jun. 8, 2017

(30) Foreign Application Priority Data

Dec. 7, 2015 (IN) ..... 3978/DEL/2015

(51) Int. Cl.

| | |
|---|---|
| ***D06M 11/38*** | (2006.01) |
| ***D01H 4/02*** | (2006.01) |
| ***D03D 27/08*** | (2006.01) |
| ***D06C 17/00*** | (2006.01) |
| ***D06M 11/84*** | (2006.01) |
| *D06M 101/06* | (2006.01) |

(52) U.S. Cl.

CPC ..... *D06M 11/38* (2013.01); *D01H 4/02* (2013.01); *D03D 27/08* (2013.01); *D06C 17/00* (2013.01); *D06M 11/84* (2013.01); *D06M 2101/06* (2013.01)

(58) Field of Classification Search

CPC ..... D01H 4/02; D03D 27/08; D06C 17/00; D06M 11/38; D06M 11/84; D06M 2101/06

See application file for complete search history.

(56) References Cited

U.S. PATENT DOCUMENTS

| | | | | | |
|---|---|---|---|---|---|
| 2,701,406 | A * | 2/1955 | Bloch | D02G 1/18 | 28/219 |
| 2,897,042 | A * | 7/1959 | Heiks | D03D 15/00 | 28/169 |
| 3,039,524 | A * | 6/1962 | Belck | D01F 8/04 | 264/168 |
| 4,255,819 | A * | 3/1981 | Klingspor | A41B 11/00 | 2/239 |
| 4,631,755 | A * | 12/1986 | Zingg | A41B 11/003 | 2/239 |
| 2011/0239352 | A1* | 10/2011 | Ramsey | A41B 11/02 | 2/239 |

* cited by examiner

*Primary Examiner* — Mark Kopec
*Assistant Examiner* — Jaison P Thomas
(74) *Attorney, Agent, or Firm* — Lerner, David, Littenberg, Krumholz & Mentlik, LLP

(57) ABSTRACT

The present invention relates to textile fabrics and methods of manufacturing textile fabrics. Particularly, the invention comprises a method of producing a fabric, comprising the steps of (i) blending chemo mechanically felting fibers with non-felting fibers into a blended feed material, (ii) spinning the blended feed material into a blended yarn, (iii) producing a fabric comprising the blended yarn, (iv) subjecting the fabric to a first fabric treatment comprising a mechanical felting treatment; and (v) subjecting the fabric to a second fabric treatment comprising a chemical treatment of the fabric with an alkali, wherein the ratio of weight of the alkali to dry fabric weight is between 0.02 and 0.05, thereby obtaining increased air space in the resultant fabric.

10 Claims, 3 Drawing Sheets

FABRIC AND METHOD OF MANUFACTURING FABRIC

FIELD OF THE INVENTION

The present invention relates to textile fabrics and methods of manufacturing textile fabrics. Particularly, the invention concerns manufacture of terry fabrics as well as non-terry fabrics having improved porosity, wettability, absorbency, and softness, in an environmentally conservative and economical manner.

BACKGROUND OF THE INVENTION

Fabrics are manufactured for several different end uses, including for sheeting, towels, terry fabrics, cleaning products, carpets and the like. Terry fabrics are considered advantageous in view of their light weight, softness, ability to pick up particles and absorb moisture. In cases where terry fabrics manufacturing methods are used to manufacture towels or other terry textiles, there is a growing need for improving moisture absorption and reducing drying time while enabling manufacture of fabrics with a pleasant aesthetic look and feel.

Figure 1A:
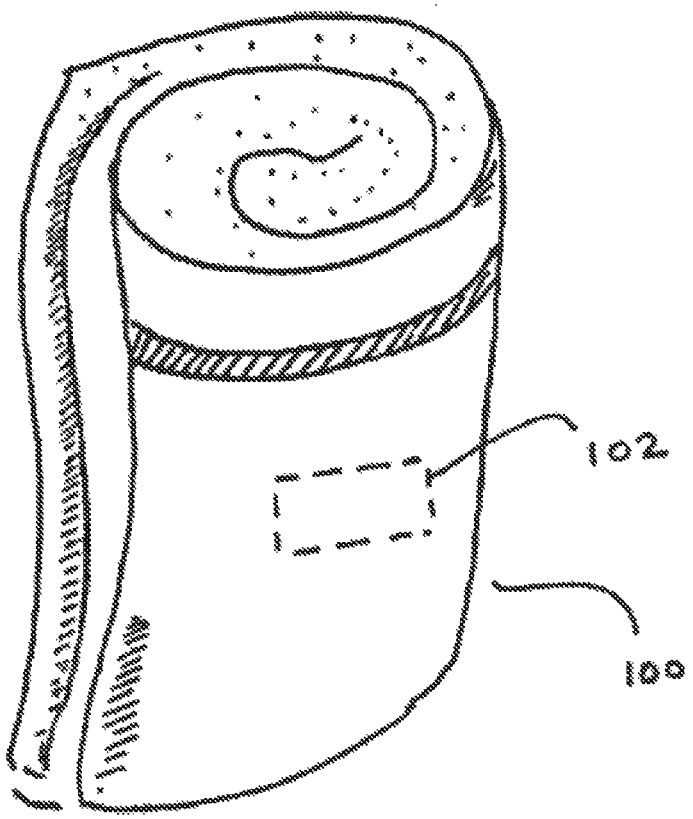

FIG. 1A illustrates a terry fabric 100 of the towel type, having a surface region 102. Terry fabrics of the kind illustrated in FIG. 1A typically comprise a woven ground fabric having a plurality of substantially parallel ground warp yarns, and a plurality of substantially parallel ground weft yarns—wherein the plurality of ground weft yarns intersect the plurality of ground warp yarns substantially perpendicularly. Additionally, a plurality of terry loop yarns are woven through the ground fabric in a terry loop weave—which terry loop weave forms a plurality of terry loops above and/or below the woven ground fabric.

Figure 1B:
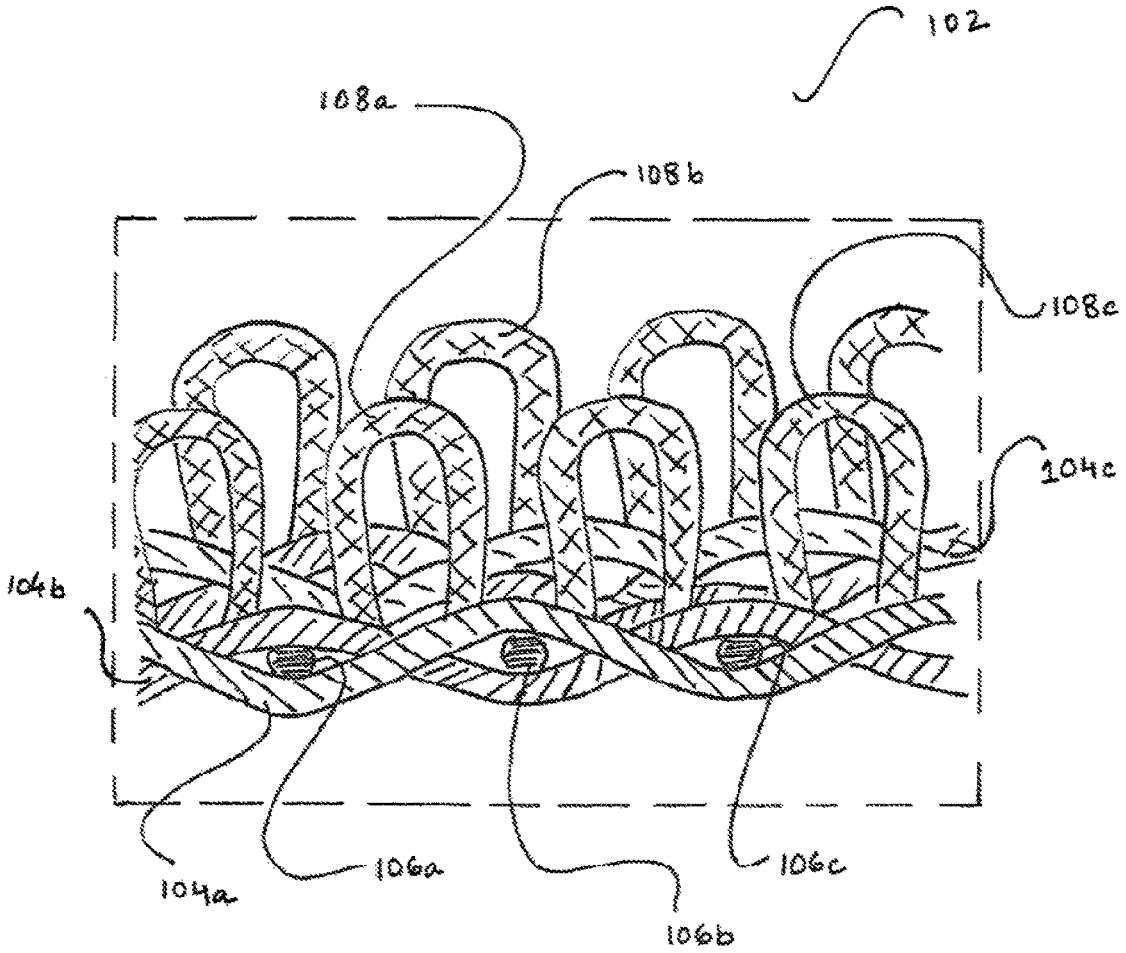

FIG. 1B provides a magnified view of surface region 102 of terry fabric 100. Surface region 102 illustrates the woven ground fabric comprising a plurality of warp yarns 104*a* to 104*c*, substantially perpendicular weft yarns 106*a* to 106*c*, and terry loop yarns woven in a terry loop weave so as to form terry loops 108*a* to 108*c* raised above the ground fabric. While not illustrated in FIG. 1B, it would be understood that a terry fabric may include terry loops on both sides of the ground fabric.

In manufacturing terry fabrics, properties such as porosity and increased softness and loft are considered advantages. A previously known approach to achieve these properties has been to weave the terry fabric using at least one yarn (preferably a terry loop yarn) comprising a cotton yarn and a water soluble synthetic thermoplastic yarn (or a single yarn comprising a blend of cotton and water soluble fibers or slivers), which fabric is thereafter washed in water to dissolve the water soluble synthetic yarn or fibers—resulting in a fabric where at least one yarn has interspaces or pores therewithin—which interspaces or pores are formed by the action of dissolving the water soluble yarn. Dissolution of water soluble fibres is an expensive process and release of industrial discharge of such water soluble fibres may pose hazardous effect on the environment.

Another conventional approach is to manufacture fabrics by way of dissolution of wools blends—since wool is known to be soluble when treated with alkali solutions. It has been observed that such approaches result in wastage of materials.

The present invention seeks to manufacture fabrics having interspaces or pores within at least one yarn of said fabric, wherein such yarn or the entire fabric has been subjected to processes that overcome the above-mentioned drawbacks and improve porosity, absorbability, wettability, softness and loft of the yarn or resulting fabric.

SUMMARY OF THE INVENTION

In various embodiments of the present invention, a method of producing a fabric is provided. The method comprises the steps of (i) blending chemomechanically felting fibers with non-felting fibers into a blended feed material, (ii) spinning the blended feed material into a blended yarn (iii) weaving a fabric comprising the blended yarn (iv) subjecting the woven fabric to a first fabric treatment comprising a mechanical felting treatment, and (v) subjecting the woven fabric to a second fabric treatment comprising treatment of the fabric with an alkali, wherein the ratio of weight of the alkali to dry fabric weight is between 0.02 and 0.05. In an exemplary embodiment of the present invention, the alkali may comprise caustic soda.

In another embodiment of the present invention, the second fabric felting treatment step may comprise treatment of the fabric with the alkali, wherein the ratio of weight of the alkali to the dry fabric weight is between 0.02 and 0.05, and wherein said treatment is carried out at a temperature of between 80° C. and 100° C., and for a duration of between 10 and 20 minutes. Further, as an option, the second fabric treatment step may be followed with a third fabric treatment of the fabric with the alkali, wherein the ratio of the weight of the alkali to the dry fabric weight is higher than 0.05, and wherein said treatment is carried out at a temperature of between 80° C. and 110° C., and for a duration of between 10 and 40 minutes.

In an embodiment of the present invention, the felting treatment may comprise wetting the woven fabric and agitating it in an agitator for between 20 and 60 minutes, at a temperature of 120° C. and at a tumbling frequency of between 35 Hz and 42 Hz.

In an exemplary embodiment of the present invention, the non-felting fibers may include any one or more of cotton fibers, silk fibers, modal fibers, acrylic fibers, rayon fibers, polyester, viscose, or any combination thereof. In an embodiment, the felting fibers are wool fibers. In other embodiments, the non-felting fibers may include any textile spinnable fibres including natural fibres, synthetic fibres, animal/plant fibres, regenerated fibres and any blends or combination of such fibres. The ratio of felting fibers to non-felting fibers in the blended feed material may comprise between 0.08 and 0.52 weight/weight. In an embodiment of the present invention, the second fabric treatment may be followed by a third treatment of the fabric with said alkali, wherein the ratio of the weight of the alkali to the dry fabric weight is lesser than 0.05.

In an embodiment of the present invention, the woven fabric is a terry fabric, and the blended yarn is a terry loop yarn within the terry fabric.

The invention additionally provides fabrics manufactured in accordance with any of the above method embodiments.

BRIEF DESCRIPTION OF ACCOMPANYING DRAWINGS

Figure 2:
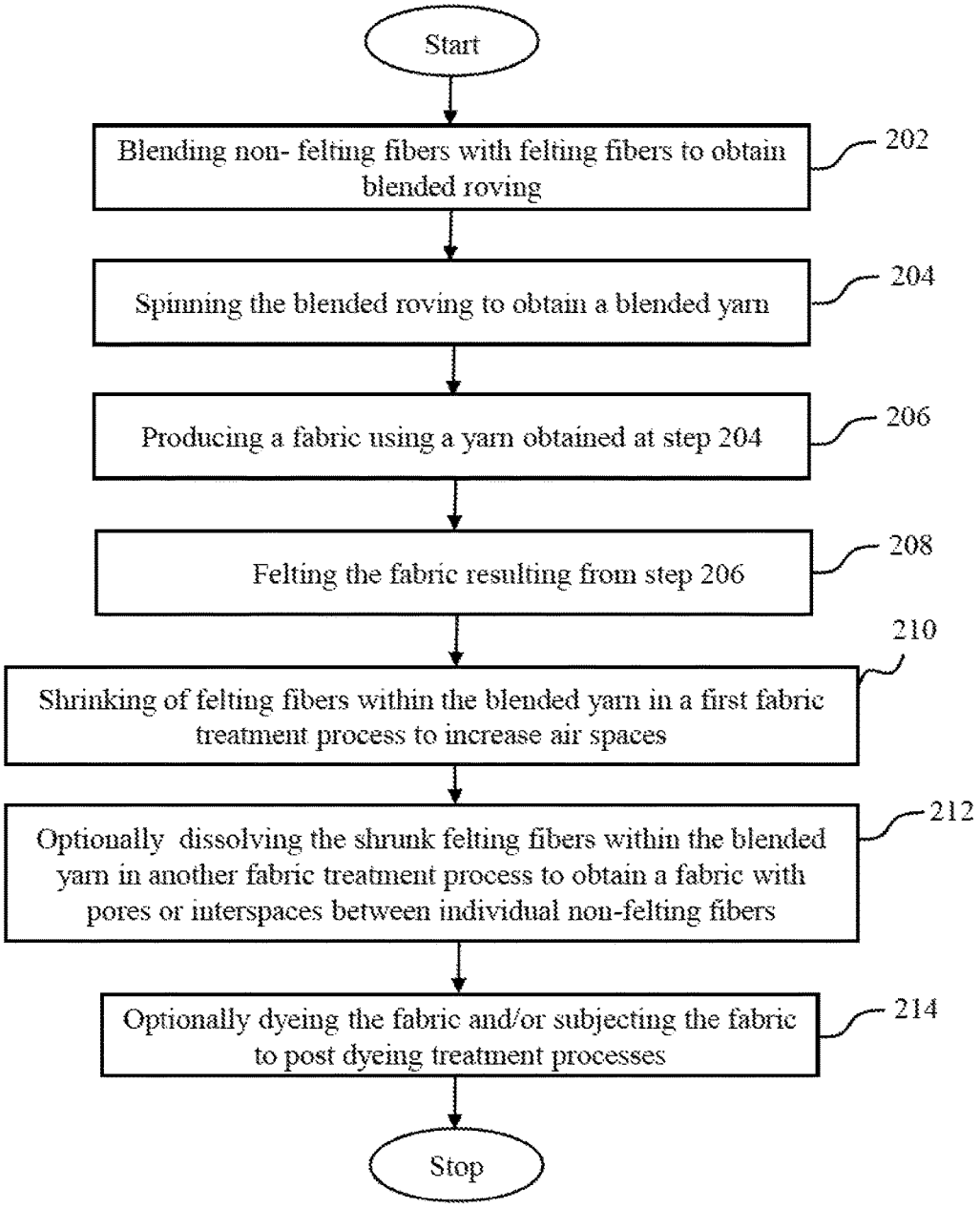

FIG. 1A illustrates a terry fabric of the towel type;

FIG. 1B provides a magnified view of a surface region of a terry fabric; and FIG. 2 illustrates a manufacturing method in accordance with the present invention.

DETAILED DESCRIPTION OF THE INVENTION

The present invention provides novel methods of manufacture for fabrics having pores or interspaces within one or more yarns therein, said fabrics having improved porosity, wettability, absorbency, softness and/or loft.

The process of manufacturing a fabric in accordance with the present invention is illustrated in FIG. 2.

Step 202 comprises blending non-felting fibers with felting fibers to obtain blended fiber slivers/blended roving/blended feed material for the yarn spinning process.

The felting fibers having felting properties may comprise any fiber(s) that has high chemo mechanical felting property as well as solubility in an alkali solution—and in a preferred embodiment may comprise wool fibers. The non-felting fibers may comprise any fiber(s) that are non-soluble in said alkali solution. The non-felting fibers may include any one or more of cotton fibers, silk fibers, modal fibers, acrylic fibers, rayon fibers, polyester, viscose, or any combination thereof. In an embodiment, the felting fibers are wool fibers. In other embodiments, the non-felting fibers may include any other textile spinnable fibres including natural fibres, synthetic fibres, animal/plant fibres, regenerated fibres and any blends or combination of such fibres.

Blending of non-felting fibers with felting fibers may be achieved in any number of different ways. In an embodiment of the invention, the non-felting fibers may be subjected to blowroom, carding, combing and breaker drawframe processing. The felting fibers may be subjected to bale opening (for example at a mixing bale opener), carding and levelling drawframe processing. The non-felting fibers and felting fibers may be blended by processing them together through at least one or more of a blending process namely drawframe, finisher drawframe, a simplex frame or a ring frame.

In an embodiment of the invention the ratio of felting fibers to non-felting fibers in the blend at step 202 may comprise between 0.05 (or 5:95) and 0.92 (or 48:52) weight/weight (wt/wt). In an embodiment of the invention the ratio of felting fibers to non-felting fibers in the blend resulting from step 202 may comprise between 0.086 (or 8:92) and 0.12 (or 10:90) wt/wt.

At step 204, a blended roving (or other feed material for a spinning frame) that results from step 202 is spun into a blended yarn. The yarn can be spun using any spinning technique including for example, ring spinning or open ended spinning. In an embodiment of the invention, the blended yarn is spun on one or more ringframes at appropriate settings. The yarn spun at step 204 may have a count ranging from about 6 Ne resultant count to about 24 s Ne resultant count for terry fabrics in single-ply or multi-ply form, and from about 10 s Ne resultant count to about 40 s Ne resultant count in single-ply or multi-ply for non-terry fabrics. The spun yarn resulting from step 204 may exhibit a twist multiplier of between 3.4 and 4.2 for terry fabrics and of between 4.0 and 4.5 for non-terry fabrics. In an embodiment of the invention, step 204 may include winding of the resulting blended yarn onto a yarn package.

Step 206 comprises weaving or knitting a fabric using a blended yarn obtained from step 204. In the case of a non-terry fabric, step 206 comprises weaving a warp yarn (i.e. a longitudinal set of yarn) with a weft yarn (which is perpendicular to and interlaced with the warp yarn) to manufacture a non-terry fabric. Weaving of a terry fabric may comprise weaving a warp yarn (i.e. the ground warp yarn), a weft yarn (i.e. the ground weft yarn) and a terry loop yarn—wherein the interlaced warp yarn and weft yarn form a ground fabric (base fabric), into which ground fabric the terry loop yarn is interwoven to form loops that protrude outwards and contribute to softness and loft of the fabric.

For the purposes of the present invention, one or more of the warp yarn/ground warp yarn, weft yarn/ground weft yarn and terry loop yarn may comprise a blended yarn resulting from step 204. In a particular embodiment, the fabric woven at step 206 is a terry fabric where the terry loop yarn comprises a blended yarn resulting from step 204 while the ground warp yarn and ground weft yarn are yarns consisting non-felting fibres only. One or more of the terry loop yarn, warp yarn or weft yarn may comprise a single or double count yarn. It would be understood that one or more of the terry loop yarn, warp yarn or weft yarn may comprise either a single ply yarn or a multi-ply yarn.

Step 208 comprises subjecting the fabric resulting from step 206 to a felting treatment or a felting process. Felt is a textile material produced by matting, compressing and/or condensing textile fibers. The process of matting, compressing and/or condensing the textile fibers is referred to as felting. Felting may be carried out on natural fibers such as wool.

Wool fibers have been found to be particularly prone to felting, on account of micro scales that are found on the surface of wool fibers. The micro scales cause an interlocking effect between wool fibers, which contribute to the matting or condensing of the fibers. To ensure that a fabric resulting from step 206 has appropriate properties to enable felting, one of the fibers is selected from among fibers that are prone to (or have a high susceptibility) to felting. Preferably, the other fiber is selected from among fibers that are not prone to (or which have a low susceptibility) to felting. In an embodiment of the invention the fibers selected for manufacture of the fabric are highly prone to chemo-mechanical felting, while the other fibers are not prone (or have a low susceptibility) to felting.

In a preferred embodiment, the chemo-mechanical felting fibers within the fabric are wool fibers, which have been found to exhibit felting and shrinkage in response to mechanical agitation in the presence of moisture and high temperature conditions. The other fibers within the fabrics are cotton fibers—which have been found not to exhibit felting in response to mechanical agitation in the presence of moisture and high temperature conditions.

In an embodiment of step 208, the felting process comprises wet felting—wherein agitation and compression of the fabric in the presence of moisture and raised temperatures causes fibers that are prone to felting and shrinkage to interlock or hook together (as part of the felting process). Simultaneously, shrinkage of these felted fibers causes an overall contraction in the length of the blended yarn containing the felted fibers. It has been found that since the overall length of the felted fibers contracts in response to shrinkage, while the length of the remaining fibers within the blended yarn does not contract. The overall shrinkage in length of the blended yarn causes a corresponding increase in diameter of said yarn. This increase in diameter of the yarn is believed to arise as a consequence of the interlocking arrangements between the shrinking felted fibers, which forces the non-shrinking fibers to contract in length without a corresponding change in overall volume. This contraction in length without a corresponding change in volume inevitably forces the non-shrinking fibers to expand outward and causes an increase in diameter of the blended yarn.

In an embodiment of step 208, felting of fabric resulting from step 206 comprises wet felting the fabric by tumbling or mechanically agitating the fabric in the presence of moisture and heat. In an embodiment, the felting process comprises wetting the fabric and agitating it in an agitator (for example, a tumbler machine) for between 20 to 60 minutes at a temperature of between 90 degrees centigrade and 130 degrees centigrade. In a preferred embodiment, the felting process comprises wetting the fabric and agitating it in an agitator for between 30 and 50 minutes at a temperature of 120 degrees centigrade, at a tumbling frequency of between 35 Hz and 42 Hz (which may be varied according to design parameters of the agitator).

Fabric resulting from felting step 208 has been found to exhibit shrinkage or contraction of overall length of the blended yarns therewithin, along with a simultaneous increase in diameter or thickness of the blended yarn within the fabric.

The fabric is thereafter subjected to a second fabric treatment process at step 210, wherein the fabric treatment process at step 210 comprises treating the fabric with an alkali under controlled conditions to cause a further shrinkage of the felting fibers. In an embodiment of the invention, the felting fibers are wool fibers and the alkali is caustic soda (NaOH). In this embodiment, the fabric is exposed to caustic soda at a temperature of between 80 degrees centigrade and 100 degrees centigrade, wherein the ratio of the weight of caustic soda to dry fabric weight is between 0.02 (or 2:98) and 0.05 (or 4.5:94.5). In a particular embodiment the ratio of weight of caustic soda to dry fabric weight is 0.042 (or 4:96). The temperature under which the first fabric treatment process is carried out is between 80 degrees centigrade and 100 degrees centigrade, and preferably is 95 degrees centigrade. The duration for which the fabric is exposed to caustic soda during the first fabric treatment process is between 10 and 20 minutes, and in a preferred embodiment is about 15 minutes.

It has been found that treating a fabric comprising a blended yarn of the type resulting from step 204, under the controlled conditions of the fabric treatment step described in connection with step 210, causes felting fibers within the blended yarn to shrink, while the length of the non-felting fibers does not exhibit a corresponding shrinkage. Shrinkage of the felting fibre (particularly in the case where such fibers have also undergone felting and prior shrinkage in the felting process) causes an overall contraction in the length of the blended yarn containing the felting fibers. However, since the length of the non-felting fibers within the blended yarn does not undergo a corresponding shrinkage, the overall shrinkage in the length of the blended yarn causes a corresponding increase in diameter of said yarn. This increase in diameter of the blended yarn is believed to arise as a consequence of the shrinking felting fibers which forces the non-shrinking fibers (non-felting fibers) to contract in length without a corresponding change in overall volume. This inevitably forces the non-shrinking fibers to expand outward and causes an increase in diameter of the blended yarn.

Step 212 comprises an optional step of subjecting the fabric to a third fabric treatment step—to remove the felting fiber entirely and manufacture a soft, high loft and super absorbent fabric which is entirely comprised of the non-felting fibers. This third fabric treatment step comprises treating the fabric with an alkali under controlled process conditions to fully dissolve the felting fibers. In an embodiment of the invention, the felting fibers are wool fibers and the alkali is caustic soda (NaOH). In this particular embodiment, the fabric is exposed to caustic soda at a temperature of between 80 degrees centigrade and 110 degrees centigrade, wherein the ratio of weight of caustic soda to dry fabric weight is higher than 0.05 (or 5:95) and preferably between 0.05 (or 5:95) and 0.21 (or 10:90). In a particular embodiment the ratio of weight of caustic soda to dry fabric weight is 0.05 (or 5:95), and the temperature under which the third fabric treatment process is carried out is 95 degrees centigrade. The temperature under which the third fabric treatment process is carried out may lie anywhere between 80 degrees centigrade and 110 degrees centigrade, and preferably is 95° C. The duration in which the fabric is exposed to caustic soda during the second fabric treatment process is between 10 and 40 minutes, and in a preferred embodiment is about 25 minutes.

As a result of the third fabric treatment process at step 212 carried out under the said controlled conditions, the felting fibers are fully dissolved from the blended yarn(s) within the fabric under treatment—wherein the action of dissolving the felting fibers results in creation of soft and 100% cotton or 100% non-felting fibre fabric. In a preferred embodiment, consequent to the combination of felting, and fabric process discussed in step 210 and the optional process of step 212, the fabric is found to comprise a fabric with yarns (i.e. those yarns which comprised a blend of non-felting fibers and felting fibers) prior to the fabric treatment process of step 212 having pores or interspaces between the non-felting fibers within said yarns. These yarns have also been found to exhibit improved loft and softness as a result of the shrinkage of overall length and increase in diameter of said yarns (which shrinkage in length and increase in diameter have arisen as a consequence of the felting and/or fabric treatment process of step 210 as applied to the fabric).

The fabric may thereafter optionally be subjected to one or more dyeing processes and/or post dyeing treatment processes at step 214. In an embodiment, after dissolving the felting fibers, the fabric may be scoured, bleached and/or dyed in a dyeing machine in any number of ways that would be apparent to the skilled person. The dyed fabric may additionally be subjected to one or more post dyeing treatment processes, including without limitation drying, stentering and/or conditioning at a shearing machine.

The fabrics resulting from one or more of the processes described in connection with steps 202 to 214 have been found to exhibit marked improvement in properties over fabrics manufactured by previously known methods, including by way of one or more of improved porosity, wettability, absorbency, loft and softness, while the manufacturing method presents the immediately apparent advantages of reducing cost and environmental impact.

The data in Table 1 (below) exhibits the improvements in properties of fabrics manufactured using one or more of the processes described in FIG. 2—when compared against fabrics manufactured using other processes. Table 1 provides comparative data relevant to properties of terry fabrics respectively manufactured and treated under each of Manufacturing Processes #1 to #6. Each of Process Conditions #1 to #6 were carried out on terry fabrics comprising a cotton ground warp yarn, a cotton ground weft yarn and a blended terry loop yarn—wherein the blended terry loop yarn comprises a blend of wool fibers and cotton fibers. The blended yarn within the terry fabrics used to derive the results in Table 1 variously comprised wool and cotton in ratios of 0.11 (or 10:90) and 0.087 (or 8:92) wt/wt. The ground warp yarn and ground weft yarn in the terry fabrics of Manufacturing Processes #1 to #6 were cotton yarns.

Manufacturing Process #1: Subsequent to the weaving step, the terry fabric is treated with caustic soda at a temperature of 95 degrees centigrade, wherein the ratio of weight of caustic soda to dry fabric weight is 0.087 (or 8:92).

Manufacturing Process #2: Subsequent to the weaving step, the terry fabric is subjected to a felting process, comprising wetting the fabric and agitating it in a tumbler for between 30 and 50 minutes at a temperature of 120 degrees centigrade, at a tumbling frequency of between 35 Hz and 42 Hz.

Manufacturing Process #3: Subsequent to the weaving step, the terry fabric is (i) subjected to a felting process, comprising wetting the fabric and agitating it in a tumbler for between 30 and 50 minutes at a temperature of 120° C., at a tumbling frequency of between 35 Hz and 42 Hz and (ii) subsequently treated with caustic soda at a temperature of 95 degrees centigrade, wherein the ratio of weight of caustic soda to dry fabric weight is 0.087 (or 8:92).

Manufacturing Process #4: Subsequent to the weaving step, the terry fabric is (i) subjected to a first fabric treatment process, comprising treating the fabric with caustic soda at a temperature of 95 degrees centigrade, wherein the ratio of weight of the caustic soda to dry fabric weight 0.041 (or 4:96) and (ii) subsequently subjected to a second fabric treatment process, comprising treating the fabric with caustic soda at a temperature of 95 degrees centigrade, wherein the ratio of weight of caustic soda to dry fabric weight is 0.053 (or 5:95).

Manufacturing Process #5: Subsequent to the weaving step, the terry fabric is (i) subjected to a felting process, comprising wetting the fabric and agitating it in a tumbler for between 30 and 50 minutes at a temperature of 120 degrees centigrade, at a tumbling frequency of between 35 Hz and 42 Hz and (ii) treated with caustic soda at a temperature of 95 degrees centigrade, wherein the ratio of weight of the caustic soda to dry fabric weight 0.041 (or 4:96).

Manufacturing Process #6: Subsequent to the weaving step, the terry fabric is (i) subjected to a felting process, comprising wetting the fabric and agitating it in a tumbler for between 30 and 50 minutes at a temperature of 120 degrees centigrade, at a tumbling frequency of between 35 Hz and 42 Hz (ii) thereafter subjected to a first fabric treatment process, comprising treating the fabric with caustic soda at a temperature of 95 degrees centigrade, wherein the ratio of weight of caustic soda to dry fabric weight is 0.041 (or 4:96) and (iii) subsequently subjected to a second fabric treatment process, comprising treating the fabric with caustic soda at a temperature of 95 degrees centigrade, wherein the ratio of weight of caustic soda to dry fabric weight is 0.053 (or 5:95).

TABLE 1

| Process Used | % Increase in Observed Shrinkage of Overall Yarn Length (compared against Observed Shrinkage of Overall Yarn Length after following Manufacturing Process # 1) | % Increase in Diameter of Yarn (compared against observed increase in Diameter of Yarn after following Manufacturing Process # 1) |
|---|---|---|
| Manufacturing Process #1 | Not applicable | Not applicable |
| Manufacturing Process #2 | 255.8% | 0.69% |
| Manufacturing Process #3 | 105.5% | 0.28% |
| Manufacturing Process #4 | 325.6% | 0.89% |
| Manufacturing Process #5 | 665.9% | 1.84% |

TABLE 1-continued

| Process Used | % Increase in Observed Shrinkage of Overall Yarn Length (compared against Observed Shrinkage of Overall Yarn Length after following Manufacturing Process # 1) | % Increase in Diameter of Yarn (compared against observed increase in Diameter of Yarn after following Manufacturing Process # 1) |
|---|---|---|
| Manufacturing Process #6 | 588.9% | 1.62% |

As will be observed from Table 1 above, the highest % increase in yarn shrinkage and increase in yarn diameter in comparison with yarn shrinkage and increase in diameter observed in the prior art process corresponding to Manufacturing Process #1 was observed respectively by following Manufacturing Process #5 and Manufacturing Process #6. In product offerings where it may be acceptable to have wool fibres present within the end product, Manufacturing Process #5 has been found to present particular advantages. In product offerings where it may not be acceptable to have wool fibres present within the end product, Manufacturing Process #6 presents particular advantages. Further, as observed from Table 1, each of Manufacturing Processes #2, #3 and #4 exhibit improvements in overall softness and loft of the resulting towel, in comparison with towels manufactured in accordance with prior art Manufacturing Process #1. It would be understood that Manufacturing Process #2 may in certain embodiments, result in an intermediate product that is subjected to further processing or fabric treatment.

Accordingly, the fabrics resulting from the processes described above has have been found to exhibit marked improvements in observable properties in comparison with fabrics manufactured by previously known methods—which observable improvements include with respect to porosity, wettability, absorbency, softness and loft. Additionally, the manufacturing methods of the present invention present advantages in terms of cost efficiencies and reduced environmental impact.

It would be understood that the examples and embodiments discussed anywhere in the present specification, are only illustrative. Those skilled in the art would immediately appreciate that various modifications in form and detail may be made without departing from or offending the spirit and scope of the invention as defined by the appended claims. Additionally, while certain embodiments and examples within this specification address terry fabrics, it would be understood that the methods of the present invention may be equally applied for manufacture of non-terry fabrics or any other textile fabrics.

We claim:

1. A method of producing a fabric, comprising the steps of:

blending felting fibers with non-felting fibers into a blended feed material;

spinning the blended feed material into a blended yarn;

producing a fabric comprising the blended yarn;

subjecting the fabric to a first fabric treatment comprising a mechanical felting treatment; and subjecting the fabric to a second fabric treatment comprising a chemical felting treatment, the treatment comprising:

treatment of the fabric with an alkali, wherein the ratio of weight of the alkali to dry fabric weight is between 0.02 and 0.05, thereby obtaining increased air space in the resultant fabric.

2. The method as claimed in claim 1, wherein subjecting the fabric to a third fabric treatment comprising treatment of the fabric with said alkali, wherein the ratio of weight of the alkali to dry fabric weight is higher than 0.05, to remove felting fibers from the resultant fabric.

3. The method as claimed in claim 2, wherein the third fabric treatment step comprises treatment of the fabric with the alkali, wherein the ratio of the weight of the alkali to the dry fabric weight is higher than 0.05, and wherein said treatment is carried out at a temperature of between 80° C. and 110° C., and for a duration of between 10 and 40 minutes.

4. The method as claimed in claim 1, wherein the first felting treatment comprises wetting the fabric and agitating it in an agitator for between 20 and 60 minutes, at a temperature of 120° C., and at a tumbling frequency of between 35 Hz and 42 Hz.

5. The method as claimed in claim 1, wherein the second fabric treatment step comprises treatment of the fabric with the alkali, wherein the ratio of weight of the alkali to the dry fabric weight is between 0.02 and 0.05, and wherein said treatment is carried out at a temperature of between 80° C. and 100° C., and for a duration of between 10 and 20 minutes.

6. The method as claimed in claim 1, wherein:

the felting fibers are wool fibers; and the non-felting fibers include one or more of cotton fibers, silk fibers, modal fibers, acrylic fibers, rayon fibers, polyester, viscose, and any other textile fiber.

7. The method as claimed in claim 1, wherein the ratio of felting fibers to non-felting fibers in the blended feed material comprises between 0.05 and 0.34 weight/weight.

8. The method as claimed in claim 1, wherein:

the fabric is a terry fabric; and the blended yarn is a terry loop yarn within the terry fabric.

9. The method as claimed in claim 1, wherein the alkali is caustic soda.

10. The method as claimed in claim 1, wherein shrinkage exhibited by the felting fibers when subjected to the felting treatment, is higher than shrinkage exhibited by the non-felting fibers when subjected to the felting treatment.

* * * * *